United States Patent [19]

Ottenhues et al.

[11] 3,955,843

[45] May 11, 1976

[54] VACUUM-LIFTING APPARATUS

[76] Inventors: Ludger Ottenhues, Weststr. 38, 4536 Brochterbeck; Wolfgang Schlaupitz, Grunring 85; Dieter Kippenbrock, Bergstr. 46, both of 4407 Emsdetten, all of Germany

[22] Filed: Oct. 15, 1974

[21] Appl. No.: 514,826

[30] Foreign Application Priority Data

Nov. 16, 1973 Germany ..... 7340967[U]

[52] U.S. Cl. ..... 294/64 R; 294/65

[51] Int. Cl.[2] ..... B66C 1/02

[58] Field of Search ..... 294/64 R, 65; 214/1 P, 214/650 SG; 269/21

[56] References Cited

UNITED STATES PATENTS

| | | | |
|---|---|---|---|
| 2,131,869 | 10/1938 | Burrell | 294/65 |
| 3,147,872 | 9/1964 | Olson | 294/65 X |
| 3,578,372 | 5/1971 | Schuler | 294/64 R |
| 3,591,227 | 7/1971 | Creskoff | 294/65 |
| 3,720,433 | 3/1973 | Rosfelder | 294/64 R |
| 3,833,251 | 9/1974 | Creskoff | 294/64 R |
| 3,858,926 | 1/1975 | Ottenhues | 294/64 R |

*Primary Examiner*—Evon C. Blunk
*Assistant Examiner*—Johnny D. Cherry
*Attorney, Agent, or Firm*—Fitch, Even, Tabin & Luedeka

[57] ABSTRACT

A vacuum lifting device for lifting articles having curved surfaces comprises at least one suction cup having a vacuum chamber subdivided into a plurality of segments which are displaceable relative to one another to conform to the surface of the article and means to automatically lock the segments at this position. More specifically, as a vacuum is formed in a vacuum chamber on the upper side of the segments and lifting force is applied to the vacuum cup, the segments are automatically locked into position at the predetermined configuration corresponding to the curvature of the article being lifted. Upon release of the lifting force, a biasing means returns the segments from their locked configuration to a released position.

8 Claims, 4 Drawing Figures

1
2
5
6
7
8
8'
9
10
11

VACUUM-LIFTING APPARATUS

The present invention relates to a vacuum lifting device, preferably for lifting articles having curved surfaces, comprising at least one suction cup adapted to be placed upon the surface of the article and adapted to be locked in its supported position, whereby a vacuum may be produced in at least a portion of said suction cup, and said suction cup comprising at least one vacuum chamber the upper side of which is subdivided into segments which are sealed in air-tight manner relative to each other and which are adapted to be displaced to limited extent relative to each other.

There is already known an apparatus for lifting articles having curved surfaces as shown in U.S. Pat. 3,858,926 wherein a suction cup is placed into the surface of the article to be lifted, with said suction cup assuming a curved configuration under gravity action and conforming itself to the surface of the article such that all segments of such suction cup are uniformly in contact with said curved surface. The segments of the suction cup are locked in this position, and a vacuum is thereafter produced between the suction cup and the surface such that the suction cup is pressed against said surface by the atmospheric pressure, and the article to be lifted may be lifted.

It has been found to be disadvantageous in the known vacuum lifting device that such device could not be controlled automatically, but rather had to be locked manually each time. If conversion was to be made from one radius of pipe curvature to another radius, the suction segments had to be released from each other, the device adapted to a given pipe diameter, and then the segments locked again.

Accordingly, it is the object of the present invention on the one hand to adapt the conventional vacuum lifting device to automatically controlled operation, and on the other hand to automatize the adaption or adjustment to a given curvature of the pipes such that manual operation of the locking mechanism becomes superfluous.

These object are solved by a vacuum lifting device of the type mentioned at the beginning, wherein the segments are adapted to be locked in a predetermined configuration corresponding to the curvature of the article to be lifted by means of a device which operates automatically during the lifting and placement of said suction cup.

The invention proposes an embodiment wherein the segments are formed by rigid ribs which, through straps and levers attached to their exposed upper faces, are interconnected in such a manner that a variably curved configuration of the segments may be obtained. By means of the levers and straps which are preferably connected to a pushrod adapted to be locked for positive movement, it becomes possible to easily lock and release the arrangement of the segments so that this operation can be automatized.

Preferably, a bellcrank is disposed between the suction cup and a drawing element being movably attached to the suction cup, which bellcrank acts against a spring biased bolt which, when the drawing element is set, holds said levers and straps by pressing them together.

The present apparatus is particularly suited for installation in automatized lifting gears because it is no longer necessary for the operator to approach the suction cup with the load thereon; rather, the suction cup is deformed automatically each time it is applied onto the surface of the article. Accordingly, for controlling the vacuum, a device is proposed whereby the suction cup can be evacuated and filled with air by remote control. First of all, this requires that a conduit is provided between the vacuum reservoir and the suction cup, which conduit communicates with the outer atmosphere through controllable valves.

Functions, characteristics and advantages of the vacuum lifting device according to the invention are explained in greater detail by referring to the drawings, wherein.

Figure 1:
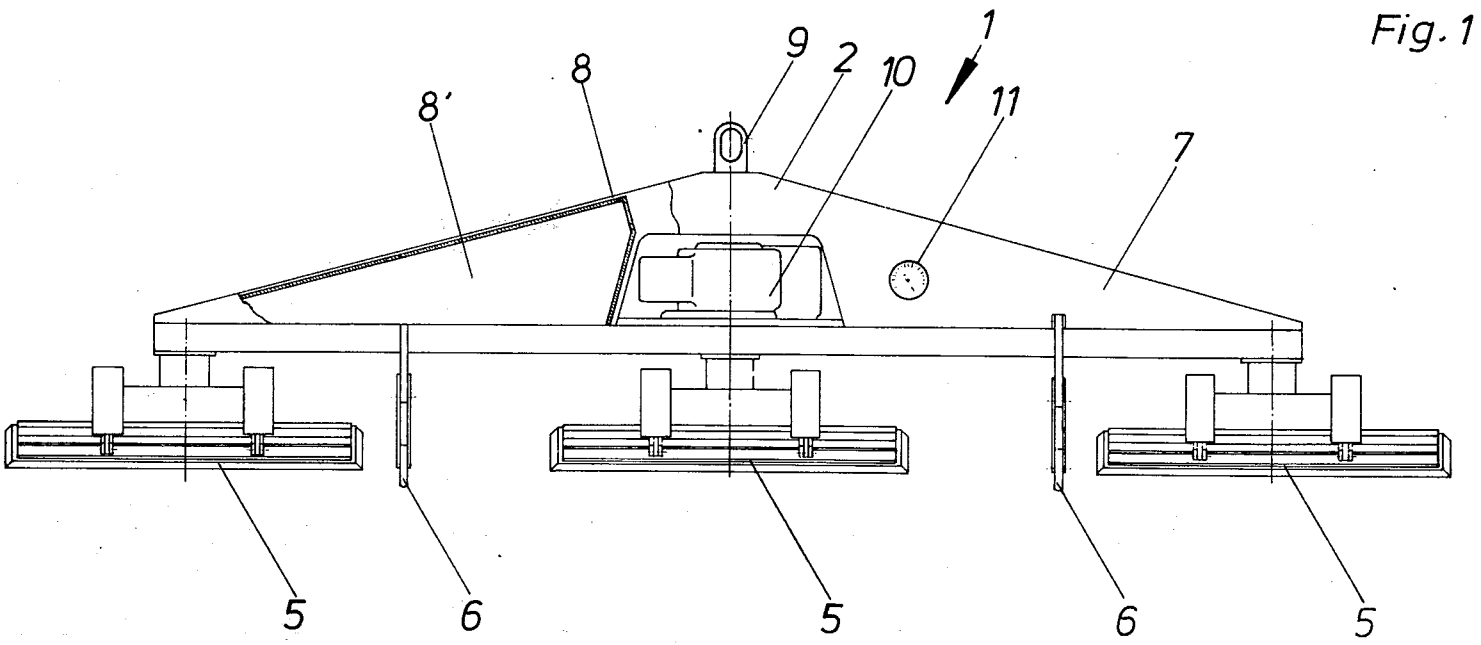
FIG. 1 is an overall view of a vacuum lifting device including three suction cups.

FIG. 1 shows in side elevational view a vacuum lifting apparatus 1 which comprises primarily a transverse rail 2 and three suction cups 5 suspended therefrom. Further, the transverse rail has mounted thereon a pair of centering devices 6 such as shown in U.S. Pat. 3,858,926. This device serves to align the vacuum lifting apparatus with respect to the cylinder axis of the curved article. In the embodiment shown, the transverse rail 2 comprises a pair of arms 7 and 8 which are joined at a heavy eye 9. The interior of each arms of said transverse rail is formed as a vacuum reservoir 8'. These reservoirs are connected in parallel, and they communicate with said suction cups through conduits. The vacuum existing in reservoirs 8' is produced or maintained by a pump 10 driven by electric or diesel engine means. Further, a pressure monitoring instrument 11 is provided in the transverse rail, which instrument indicates the pressure condition to the operator.

Figure 2:
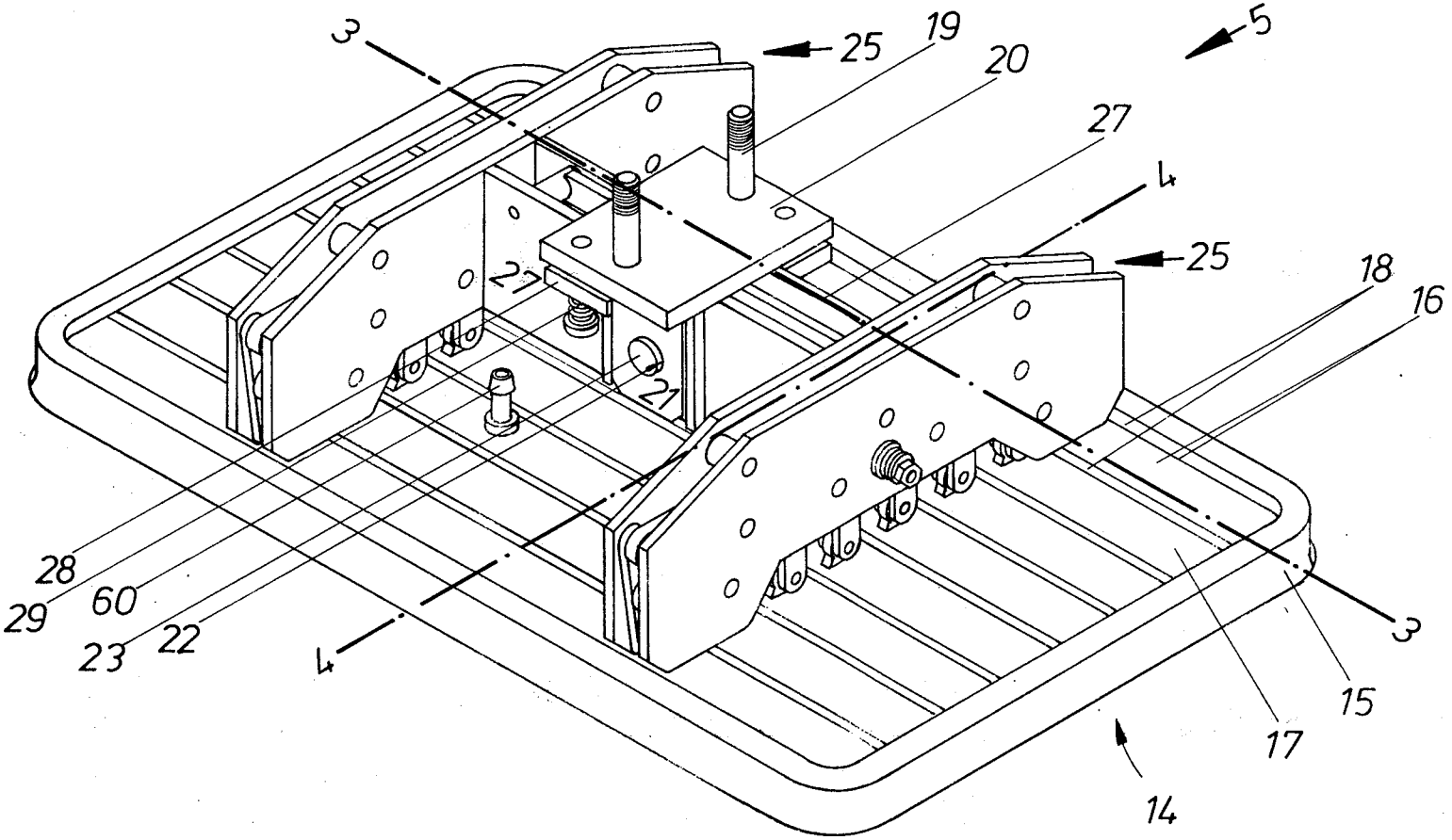
FIG. 2 is a perspectivic view of a suction cup.

The details of the suction cup can be seen particularly from FIG. 2. The vacuum chamber 14 of the suction cup 5 comprises a peripherally continuous rubber sealing ring or gasket 15 which is flexible and adapted to conform itself to the surface of a curved body. The area intermediate the edges of the rubber gasket is bridged by flat segments 16 extending in parallel with each other and consisting of rigid ribs 17 being embedded into a continuous sealing plate 18 which is framed by the rubber gasket 15. The constuction of the vacuum chamber is clearly evident from the sectional view of FIG. 4.

The suction cup 5 is connected to the transverse rail 2 in a known per se manner by means of a suspension through a pair of heavy bolts 19. The following decription refers to that portion of FIG. 2 which is viewed in front of the sectional plane 3—3. The same arrangement is symmetrically present on the other side of the sectional plane. Bolts 19 are threaded to a plate 20 the underside of which carries a vertically depending sliding element 21. The plate-shaped sliding element 21 has a bore 22 with an axle 23 fitted in said bore. Between a pair of gear boxes 25, a pair of vertical walls 27 are disposed parallel to the segments 16, which walls define a space therebetween. Oppositely disposed elongated holes are milled into the mid portions of both vertical walls 27, in which holes the sliding elements 21 are supported through an axle 23. On the outer side of a wall 27 each, there is secured a support plate 28 against which a compression spring 29 reacts which is wound around a bolt 30 having a head or cap 31, said bolt in turn being securely connected to the plate 20.

The spring 29 urges the cap 31, and thus the plate 20 including the two sliding elements 21 and the axle 23, in downward direction.

The axle 23 extends from the sliding element 21 positioned on one side of the walls 27 to the respective opposite element. The axle 23 is straddled by the bifurcated end 33 of a bellcrank 34. A short arm 35 of the bellcrank terminates at a pivot point or fulcrum 36. The free end of the short arm 35 is connected to a bolt 37 which extends through the gear box 25 and which is mounted in the sidewalls 39 and 40 of the box 25. The inner faces of said walls 39, 40 have attached thereto brake discs 41, 42 which surround the bolt 37. The end of the bolt is secured by nuts 44.

Figure 3:
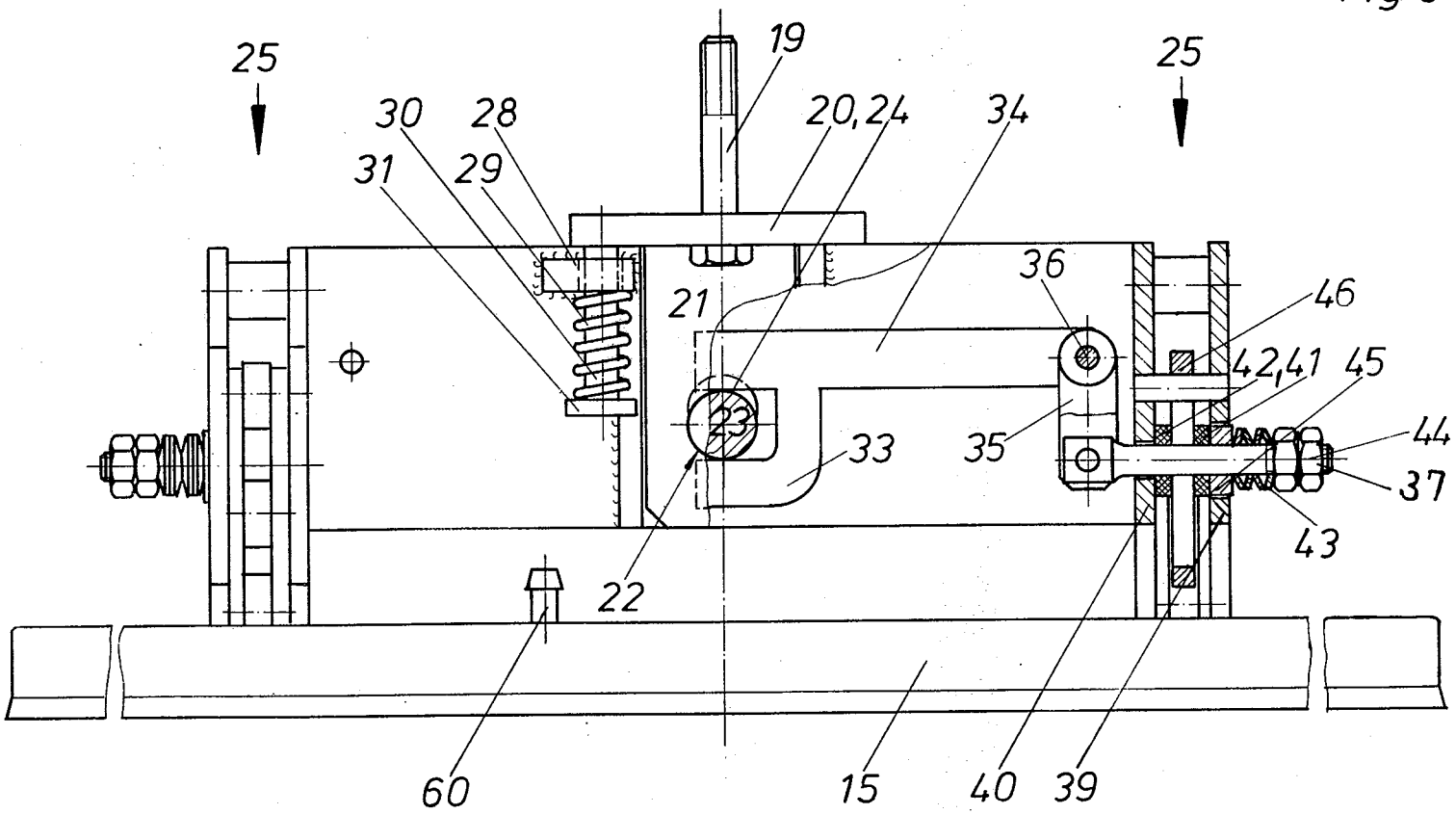
FIG. 3 is a sectional view along lines 3—3 of FIG. 2.

The bellcrank mechanism shown in detail in FIG. 3 operates as follows: When, with the suction cup 5 loaded, a force is applied to the plate 20, then the axle 23 is moved upwardly within the elongated hole 24 against the force exerted by the spring 29. In this way, the long end of the bellcrank 34 is urged upwards, thereby drawing the bolt 37 in inward direction, whereby a retaining force is applied to a pushrod 46 positioned in the box 25 through the loosely mounted pushing or sliding element 45 and the brake discs 41, 42. This pushrod is thereby locked so that is simultaneously retains the segments 16 of the pressure chamber of the suction cup which assume a curved configuration, in a predetermined position which is explained in greater detail below. When the force applied to the plate 20 is released, the spring 29 urges the plate, and thus the long end of the bellcrank, downwards. This action disengages the bolt and releases the pushrod 46 so that the assembly of the segments is released again.

Figure 4:
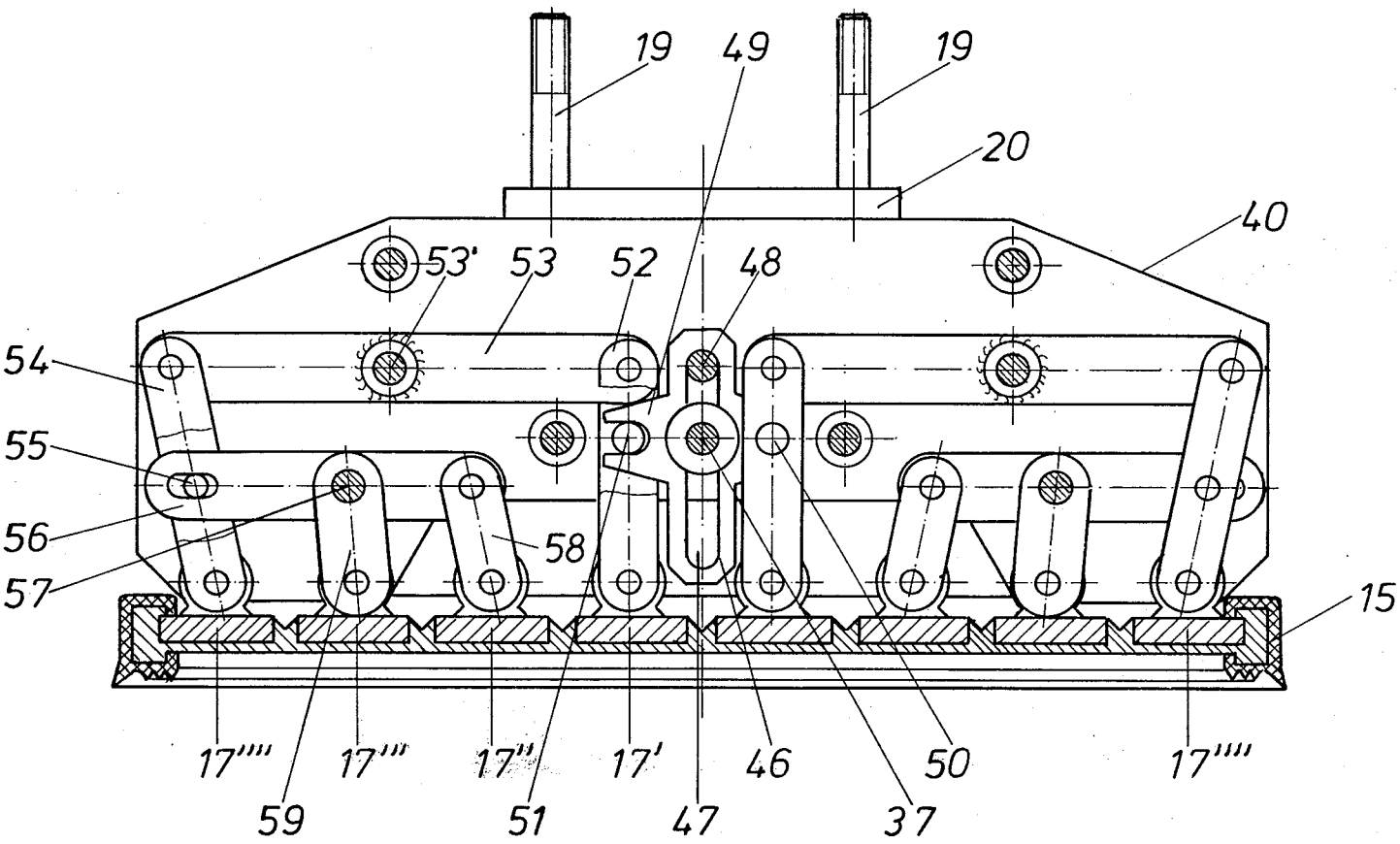
FIG. 4 is a sectional view along lines 4—4 of FIG. 2.

The assembly consisting of the levers and straps interiorly of the gear box can be seen from FIG. 4. FIG. 4 is a side elevational view of the lever assembly, whereby the segments 16 are cut away in the plane of the rear face of the plate 39. It can be seen from FIG. 4 that the upper side of the vacuum chamber comprises a total of eight segments with four segments each being disposed on either side of the plane of symmetry (dash-dot-line). Precisely in the center position, the pushrod 46 is positioned which pushrod is provided with an elongated hole 47 the longitudinal edges of which slide as guiding surfaces along the bolts 37 and 48 and in the terminal or limit point about the stop bolt 48 when the upper face of the suction chamber is horizontal. Approximately in the mid portion, the pushrod 46 includes a pair of bifurcated guide means 49 which each straddle a lug 50 or 51, respectively. Each lug is connected to a double strap 52 having one end thereof pivoted to a long lever 53 and having its other end pivotally connected to the free upper side or top of the innermost rib 17'. The long lever 53, in turn, is centrally mounted on a pivot point or fulcrum 53' which is securely connected to the two sides 39 and 40 of the gear box 25. The outwardly directed end of the lever 53 is pivotally connected to the end of another double strap 54 the other end of which is connected to the outermost rib 17''''. Strap 54 carries in the mid point thereof a pivot pin 55 which engages into the elongated hole at the end of a further lever 56. Lever 56 is centrally mounted in pivotable fashion on a fulcrum 57 which is fixedly attached to the side walls 39 and 40. The inwardly directed end of this lever is connected to the centrally inner rib 17'' through a strap 58. At the fulcrum 57, adjacent the lever 56 there is pivotally mounted with its end another short strap 59 the other end of which is connected to rip 17'''. This arrangement is symmetrically doubled on the opposite side of the plane of symmetry. Thus, summarizing it may be said:

a. The outermost and innermost ribs are each connected to the end of the centrally suspended pivot lever 53 through suspended straps 52 and 54, respectively;
b. strap 52 is connected to the arrestable pushrod 46 through a lug 50;
c. the outermost strap 54 is connected, through lug 55, to a second centrally rotatably mounted pivot lever 56 by means of an elongated hole, which lever supports with its other end the centrally inner rib 17''.
d. the centrally outer rib 17''' is connected to the fulcrum of the second pivot lever 56.

It can be seen from the specification and from viewing the Figures that when the pushrod 46 is arrested, the entire positively interconnected system of the two by four ribs is locked, too. On the other hand, when the pushrod is loosely slidable, only ribs 17''40 are in their position, whereas ribs 17', 17'' and 17'''' are adapted to be moved in upward and downward direction relative to the firstmentioned rib. It has been found that by means of this lever assembly the segments can be displaced in such a manner that the upper side of the vacuum chamber 14 may be made to conform itself to substantially any encountered radius of curvature of cylindrical articles. As explained, the pushrod 46 is released by means of the bellcrank mechanism and of the compression spring 29 when no load is supported by the suction cup. As shown in FIG. 2, a pair of swith or gear boxes 25 is provided. The lever mechanisms in both boxes are identical to that shown in FIG. 4.

The function of the suction cup is as follows. When the suction cup is unloaded, the leverage is loose or released (bolt 37 disengaged). In this condition, the suction cup is lowered onto the curved article to be lifted. Hereby, the edges of the rubber gasket 15 in all positions thereof are pressed against the surface of the article so as to define a closed suction or vacuum chamber 14. Thereupon air is evacuated through a fitting 60 which communicates with the vacuum reservoir 8', to thereby produce a vacuum. Then, the atmospheric pressure forcefully presses the suction cup onto the surface such that the lifting operation can be commenced. As soon as in this operation the bellcrank end 33 is urged upwardly, the pushrod 46 is retained, whereby the complete lever system within the gear boxes 25 is locked. When the suction cup is relieved, the bolt 37 is disengaged by the action of the spring 29 and the pushrod 46 is released. The segments are returned into a horizontal position under the gravity of the ribs 17' and 17'' and by the elasticity of the gasket 15 and of the plate 18, such that the suction cup may then be lowered onto the next object. Hereby, it is inessential whether such object has a curved or a linear surface.

What we claim is:

1. In a vacuum lifting apparatus for lifting articles having an axially symmetrically curved surface, a vacuum lift device comprising: a flexible main plate, a plurality of rigid side-by-side elongated segments carried on said main plate for angular movement relative to each other to define a curved configuration adapted to the curved surface of the article, a plurality of seals associated with said segments and projecting from said main plate, a sealing rim of resilient material projecting from said main plate to engage said article and to form an air seal therewith and encircling said segments and said seals, locking lever means connected to said segments and movable between a locking position to lock the segments in positions defining a curved configuration and a release position in which said segments are free to shift relative to one another, operating means actuated by an upward lifting force applied to said vacuum lifting device to operate said locking lever means into said locked position to hold said segments in a locked curved configuration, and biasing means operable upon release of said lifting force from said operating means for releasing said segments for shifting relative to one another.

2. A vacuum lift device according to claim 1 in which said locking lever means comprises a pushrod adapted for positive movement, a plurality of levers and straps extending from said pushrod to said segments and brake discs for locking said pushrod against movement.

3. A vacuum lifting apparatus according to claim 2 in which said operating means comprises a drawing element movably attached to a suction cup, and in which said operating means further comprises a bellcrank operable by said drawing element to lock said pushrod and in which said biasing means comprises a spring urging said bellcrank in the opposite direction.

4. In a vacuum lifting apparatus for lifting articles having an axially symmetrically curved surface, a vacuum lift device comprising: a flexible main plate, a plurality of rigid side-by-side elongated segments carried on said main plate for angular movement relative to each other to define a curved configuration adapted to the curved surface of the article, a plurality of seals associated with said segments and projecting from said main plate, a sealing rim of resilient material projecting from said main plate to engage said article and to form an air seal therewith and encircling said segments and said seals, strap means pivotally connected to the outer side of said segments at first ends thereof, means for locking said strap means to hold said segments at an angular relationship defining a desired curved configuration, said segments and locking means being positioned in mirror symmetrical fashion to a plane of symmetry which also intersects suspension means of each vacuum lift device, said locking means comprising levers which are interconnected to second ends of the strap means, one of said levers being a centrally mounted pivot lever connected through suspended straps to the outermost and innermost ones of said segments, an arrestible element movable with lifting of an article, a lug connecting said arrestible element with the strap connected to said innermost segment, a second centrally rotatably mounted pivot lever connected to straps and supporting the centrally inner segment, a lug on said outermost strap connected through an elongated hole in said centrally rotatably mounted pivot lever, the centrally outer segment being connected to the pivot point or fulcrum of said second pivot lever.

5. A vacuum lifting device according to claim 4 in which said arrestible element comprises a pushrod and in which a spring biased bolt is movable to lock said pushrod.

6. A vacuum lifting device according to claim 5 in which said bolt is positioned in an unlocked position during the lifting of the suction cup into the supporting position and during placement of the suction cup under the article to be lifted.

7. A vacuum lifting device according to claim 6 in which a drawing element is attached to a suction cup to be moved thereby, a bellcrank is connected to said drawing element to be moved by said drawing element, said bellcrank being connected to said bolt to shift the same between its locked and released position.

8. A vacuum lifting device according to claim 7 in which a spring is provided between said suction cup and said drawing element, said spring urging said bolt into the release position when the suction cup is unloaded.

* * * * *